US005813235A

United States Patent [19]

Peterson

[11] Patent Number: 5,813,235

[45] Date of Patent: Sep. 29, 1998

[54] RESONANTLY COUPLED α-STIRLING COOLER

[75] Inventor: Richard B. Peterson, Corvallis, Oreg.

[73] Assignee: The State of Oregon Acting by and through the State Board of Higher Education on Behalf of Oregon State University, Corvallis, Oreg.

[21] Appl. No.: 804,932

[22] Filed: Feb. 24, 1997

[51] Int. Cl.[6] ..... F25B 9/00; F01B 29/10

[52] U.S. Cl. ..... 62/6; 60/518; 60/520

[58] Field of Search ..... 62/6; 60/518–526

[56] References Cited

U.S. PATENT DOCUMENTS

| | | | |
|---|---|---|---|
| 3,548,589 | 12/1970 | Cooke-Yarborough . | |
| 4,490,974 | 1/1985 | Colgate . | |
| 5,032,772 | 7/1991 | Gully et al. | 62/6 X |
| 5,088,288 | 2/1992 | Katagishi et al. | 62/6 |
| 5,245,830 | 9/1993 | Aubrun et al. . | |
| 5,457,956 | 10/1995 | Bowman et al. . | |
| 5,477,686 | 12/1995 | Minas | 62/6 |
| 5,582,013 | 12/1996 | Neufeld | 62/6 |
| 5,647,216 | 7/1997 | Garrett | 62/6 |

FOREIGN PATENT DOCUMENTS 44 29 602 A1 2/1996 Germany .

OTHER PUBLICATIONS

M.W. Zemansky & R.H. Dittman, *Heat & Thermodynamics*, 6th Ed., 1981, pp. 146–153.

Martin A. Shimko, et al., "Diaphragm Defined Stirling Refrigerator," IECEC, vol. 2 of 4, 1994, pp. 909–914.

Martin A. Shimko, et al., "Diaphragm Defined Stirling Refrigerator," IECEC, vol. 4 of 4, 1994, pp. 1796–1801.

*Primary Examiner*—Christopher Kilner

*Attorney, Agent, or Firm*—Klarquist Sparkman Campbell Leigh & Whinston, LLP

[57] ABSTRACT

A resonantly coupled α-Stirling cooler has hot and cold variable-volume chambers, a regenerator, and a driver for maintaining reciprocating gas displacement between the chambers. Only the hot side of the cooler is driven; the cold side responds passively by resonant coupling. The phase difference between volume oscillations in the hot and cold variable-volume chambers are altered by adjusting the driving frequency.

11 Claims, 5 Drawing Sheets

RESONANTLY COUPLED α-STIRLING COOLER

TECHNICAL FIELD

This invention relates to refrigerators and cryocoolers operating on the Stirling cycle.

BACKGROUND OF THE INVENTION

In a refrigerator or cooler, work is used to transfer thermal energy from a low-temperature (cold) reservoir to a high-temperature (hot) reservoir, typically the environment.

In vapor compression refrigerators, heat transfer is accomplished by cyclically evaporating a working fluid to form a vapor, and then condensing the vapor to reform the fluid. Heat is absorbed from the cold reservoir during evaporation and then rejected to the hot reservoir during condensation. Although vapor compression coolers are in widespread use, they are relatively complex, employing a condenser, evaporator, and mechanical compressor, as well as plumbing to circulate both liquid and vapor. Furthermore, they often employ chlorofluorocarbons (CFCs), which have been implicated in stratospheric ozone depletion.

In contrast, gas cycle refrigerators employ a working "fluid" which remains in the vapor phase, simplifying operation. Certain especially useful gas cycle refrigerators make use of the Stirling cycle, in which heat is absorbed from the cold reservoir during an isothermal expansion and rejected to the hot reservoir during an isothermal compression. These isothermal steps are connected by intervening isovolumetric steps, which involve energy storage and reclamation using a regenerator.

Stirling cycle coolers have been particularly successful for cooling tasks involving large temperature differences (cryocooling); however, the mechanical complexity of their drivers and their inefficient operation at small temperature differences have prevented them from achieving widespread application. For example, some Stirling cycle refrigerators have pistons to displace volume. Such use of pistons leads to frictional losses and blow-by of working gas, shortcomings that worsen as piston size is reduced. Moreover, steps that are intended to be isothermal are often significantly adiabatic, reducing cooler efficiency.

Some of these shortcomings have been addressed. As disclosed in U.S. Pat. No. 3,548,589 to Cooke-Yarborough, frictional losses and blow-by can be reduced by using flexible walls and sealed chambers, rather than pistons. Furthermore, as disclosed in U.S. Pat. No. 4,490,974 to Colgate, isothermal heat transfer can be facilitated by the use of convoluted or rippled bellows, which maximize surface area and decrease the distance between gas and surface.

It has been recognized that compression work supplied by the hot-side flexible chamber to the gas, and transferred to the cold-side flexible chamber through the regenerator by the pressurized gas, must be removed from the cold-side section by some means. In mechanically coupled systems, this expansion work is usually removed by a connecting rod attached to a common crank mechanism. For Stirling machines that rely on resonant processes, it has been recognized that some form of transducer must be attached to the cold-side flexible element to absorb expansion work and remove it from the cold section. It has also been recognized that there is a need for controlling the phase difference between the hot and cold-side flexible chambers for example by attaching a transducer (acting in a motor or generator mode) to the cold-side flexible chamber. For theoretical operation, a phase of 90° is optimal for achieving a cooling effect. There are many options to perform this transducer/controller function on the cold-side flexible chamber. Mechanical linkages, electromechanical drive mechanisms such as voice coil assemblies, and piezoelectric devices can all be constructed so that the motor/generator feature with phase control can be imposed on the resonant action of the cold-side flexible chamber.

Despite this current state in the art of Stirling machines, present day coolers still have significant disadvantages. Generally, complicated drive machinery with many moving parts is employed to drive gas exchange between hot and cold chambers, making miniaturization and lightweight construction difficult. Cold-side driving leads to thermodynamic inefficiencies, as do the moving regenerators found on some coolers. Finally, mechanical drivers do not allow simple adjustment of the phase difference between volume oscillations of the hot and cold elements making up the variable volume chambers, an adjustment that is necessary to optimize performance as temperature changes.

Therefore, a need exists for a simple, lightweight, thermodynamically efficient cooler with relatively few moving parts that can be miniaturized for applications such as cooling electronic components or providing mobile, temporary refrigeration.

SUMMARY OF THE INVENTION

The present invention provides a Stirling cooler which has a vessel with walls that define hot and cold variable-volume chambers and a passageway that connects the chambers. The cooler also has a regenerator and a driver for maintaining reciprocating gas displacement. The driver is connected to the hot-side chamber, with the cold-side chamber responding passively through resonant coupling. The walls which form the variable-volume chambers may at least in part be flexible elements, such as nested rippled bellows or corrugated diaphragms, although other elements such as pistons are not precluded. The regenerator may be fixed in position, or allowed to move. The driver may be an electromagnet yoke and coil, voice coil driver, linear short-displacement motor, piezoelectric device, a regenerative displacer externally driven and operating between two temperature extremes, or a Stirling engine.

The present invention also provides a method for changing the phase difference between volume oscillations of the hot and cold chambers in a Stirling cooler by adjusting the drive frequency.

DETAILED DESCRIPTION

Figure 1:
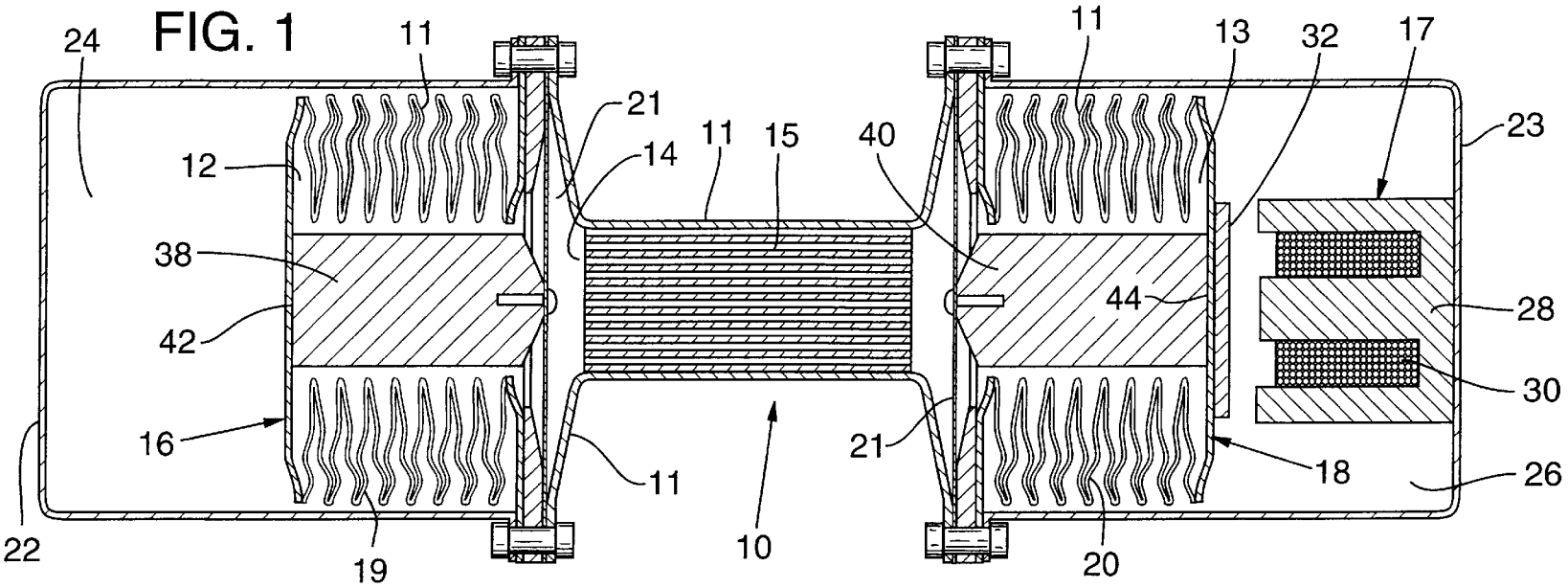
FIG. 1 is a schematic diagram of a resonantly coupled α-Stirling cooler according to the present invention.

FIG. 1 shows a resonantly coupled α-Stirling cooler in the form of a gas-tight vessel 10 having walls 11 which define cold and hot variable-volume chambers 12, 13 and a passageway 14 which connects the chambers 12, 13, permitting gas exchange. A regenerator 15 is located in the passageway 14. The cooler also has a driver 17 for maintaining reciprocating gas displacement. Cooling is obtained by the properly tuned shuttling of a working fluid, typically a low molecular weight gas, between the two variable-volume chambers 12, 13.

For the purposes of this disclosure, the cold variable-volume chamber 12 and its surrounding walls are referred to collectively as the cold-side element 16; and the hot variable-volume chamber 13 and its surrounding walls are referred to collectively as the hot-side element 18. The elements 16, 18 are contained in gas-tight casings 22, 23.

Those mechanical portions of the hot-side element which move in response to operation of the driver 17 are referred to collectively herein as the hot-side moveable member. And, similarly, those mechanical portions of the cold-side element which move in response to motion of the hot-side moveable member are referred to collectively herein as the cold-side moveable member. Thus, in FIG. 1, the hot-side moveable member consists of the flexible and inflexible portions of the walls 11 that are located on the hot side of the regenerator 15 and that are moved by the driver 17, a spring plate 21, a plate 32, and a plug 40, which are described below. The cold-side moveable member consists of a spring 21, a plug 38, and the flexible and inflexible portions of the walls 11 that are located on the cold side of the regenerator 15 and that move in response to movements of the hot-side moveable member. The movable members are sometimes also referred to herein as volume-changing elements.

A variety of working fluids can be used. Best performance is obtained with hydrogen or helium gas at an elevated pressure. These lighter gases increase the acoustic velocity, permitting higher frequency operation. They also increase the overall rate of heat transfer. Further enhancements in system performance may be obtainable by doping these lighter gases with a small percentage of a heavier gas; addition of a small percentage of a high molecular weight noble gas, such as xenon, to helium has been shown to reduce the Prandt1 number by more than one-half. This has favorable consequences for reducing the relative effects of pressure drop (fluid friction in the regenerator) to that of heat transfer thus improving the overall performance of the refrigeration cycle.

The walls which define the variable-volume chambers 12, 13 preferably are formed at least in part by flexible portions 19, 20, most beneficially nested rippled bellows as shown in FIG. 1 or corrugated diaphragms as shown in other figures. Flat diaphragms or close-fitting, mechanically-sprung pistons or disks (not shown) could also be used. If pistons are used, rubbing seals should be avoided because piston motion must be nearly frictionless for resonant operation. Instead, a piston configuration might use a close-tolerance seal and one or more linear flexural springs to hold the piston in its cylinder while operating.

Heat transfer occurs across the walls of the variable-volume chambers. Each chamber is designated cold or hot based on whether it is in thermal communication with the region from which heat is extracted (cold) or to which heat is rejected (hot). Heat is normally rejected to the atmosphere or, alternatively, to a supply of cooling water.

To facilitate the isothermal heat transfer necessary in the Stirling cycle, the variable-volume chambers should be constructed so that no large volume of gas is distant from a wall 11. FIG. 1 illustrates one way to achieve this end for the type of element that has flexible metal bellows. Solid or hollow plugs 38, 40 are attached to the moving ends 42, 44 of the bellows assemblies, occupying the middle volumes of the variable-volume chambers 12, 13 and displacing gas toward the walls 11. These plugs 38, 40 also have the feature of permitting the mass of the movable members to be increased. This gives the designer of the cooler flexibility in setting the resonant frequency of the movable members in order to obtain a desirable operating frequency for the device.

A restoring force biases each volume-changing element toward some equilibrium position. This restoring force can be provided by a gas spring. In the embodiment of FIG. 1, gas springs are provided by the volumes of gas trapped within the sealed and pressurized chamber 24 (which is defined by the element 16 and casing 22) and the chamber 26 (defined by the element 18 and casing 23). Linear flexural springs 21 may also be used to stabilize the movable members. The overall spring constant for each flexible element includes contributions from the gas spring, the linear flexural springs, and any additional restoring forces that are employed.

The regenerator 15 is constructed of materials that absorb and reject heat energy as the gas is cycled back and forth between the chambers 12, 13. The regenerator is specifically fashioned so that flow of the working fluid through passages in the heat absorbing material facilitate heat transfer. Thus, regenerators are designed to have the largest practical surface areas. Specific designs include a tube filled with stainless steel wire mesh, a dimpled low conductivity metal sheet rolled up into a Swiss-roll arrangement, a plurality of tubes, again made from a low thermal conductivity material. Other designs have been either developed or proposed and could be used for the larger resonantly coupled Stirling coolers described here. For the construction of miniature coolers, special techniques may be needed to fabricate small, engineered structures for the regenerator. Microchannel plates having a plurality of grooves, holes, pins, fins, or channels are preferred. A regenerator of this type could be constructed using techniques derived from the microelectronics industry and being actively developed by the MEMS (microelectromechanical) research community. These techniques include selectively etching a layered polymeric material to form a mold. This mold would then be electroplated to grow a suitable microchannel regenerator for miniature Stirling coolers.

The illustrated driver 17 is a stationary electromagnetic yoke 28 and coil 30 attached to the end wall of the rigid casing 23. A plate 32 of magnetic material, such as iron, nickel, or other metal or magnetic alloy, is connected to the hot-side movable member with a gap between the yoke 28 and plate 32. The coil 30 is supplied with a time-varying current creating a time-varying magnetic field in the yoke 28. The plate 32 of magnetic material, if it is able to trap and guide the magnetic lines of force, responds to the time-varying magnetic field by being attracted to the stationary yoke 28. This attractive force will also alternate according to the frequency of the coil current thus alternately closing and opening the gap between the yoke 28 and plate 32. The varying force is appropriately tuned to maintain reciprocating gas displacement between the variable-volume chambers 12, 13. The flexible element spring force provides the restoring effect when the current waveform is at its minimum values.

There are no moving, mechanical parts connecting the driver 17 to the hot-side element 18 in this embodiment. Alternative electric drivers (not shown) include voice coil drivers, linear short-displacement motors, or piezoelectric devices which may involve a mechanical driving linkage between the hot-side movable member and another part of the cooler, such as the casing 23.

Refrigeration is achieved by running the working gas through the steps comprising the Stirling cycle. The hot-side element 18 is used to compress the gas isothermally, whereupon the heat of compression is transferred from the gas to the environment across the walls of the hot variable-volume chamber 13. The two elements, moving together (but out of phase), next shift the compressed gas isovolumetrically toward the cold side. The cold-side moving member expands in volume thus expanding the gas in the cold variable-volume chamber 12. This expansion ideally occurs isothermally, whereupon heat is transferred to the gas in the cold chamber 12 from the surrounding environment across the walls of the cold chamber. Finally, the elements, again acting together, isovolumetrically displace gas back to the hot-side element 18, where heat acquired from the cold-side element 16 will be rejected to the environment as the cycle repeats.

Only the hot-side element 18 is driven; cold-side motion occurs passively through resonant coupling. When the hot-side element 18 is driven sinusoidally, the gas inside the variable-volume chamber 13 is alternately compressed and expanded. The working gas communicates the pressure variation to the element 16 residing in the cold section. This cold-side element 16 is designed to resonate at the operating frequency of the cooler. The hot-side element 18, being forced to oscillate by the driver 17, can operate in the frequency range around the resonant point of the cold-side element 16. This hot-side element 18 and its driver 17 can be designed for a resonant frequency at or near that of the cold-side element 16. When the hot-side element 18 is being driven at the resonant frequency of the cold-side element 16, the phase difference between the oscillations of their volumes should be 90° with the cold-side element 16 leading. This is the theoretical optimal phase difference for producing a cooling effect. However, by changing the hot-side driver frequency, the phase difference can be varied widely so that a practical best phase shift can be sought during cooler operation.

Because the elements operate sinusoidally, the compression-shift-expansion-shift processes overlap somewhat. Moreover, the illustrated flexible wall portion 19, 20 of each element may move only a small amount. However, neither of these effects changes the overall operation of the cooler. Independent of whether the gas is highly compressed and shifted entirely to the cold side before expansion, or lightly compressed and shifted through just part of the device, a cooling effect is generated.

The absence of a mechanical linkage between the two variable-volume chambers 12, 13 greatly simplifies the cooler and permits adjustment of the phase difference by changing the drive frequency. The latter ability can be demonstrated by mathematically modeling coupled, oscillating systems with two degrees of freedom. Such modeling shows that two masses having independent spring constants and coupled through a compressible gas (essentially a third spring) can be made to shift their relative phase when the frequency is varied near their resonant point. To model the invention, one mass (representing the mass of the hot-side movable member) can be driven with a forcing function while the other (representing the mass of the cold-side movable member) vibrates in sympathy. In this mathematical modeling, spring constants are also introduced representing the combined effects of the gas spring, mechanical spring of the element itself, and any other non-dissipative restoring force. With this mathematical model, the driven mass can be made to lead the driving mass by any phase angle from near zero to 180° by adjusting the driving frequency around the cold-side resonant point. In order for the system to remain stable, a damping effect must be mathematically imposed on the cold-side oscillating mass in order to dissipate a portion of compression work being supplied by the hot-side element 18. This dissipation effect is provided by the working fluid flowing through the regenerator. In some cooler designs, if the regenerator does not provide all the dissipation required, a flow restriction (essentially an orifice) can be added to the hot end of the regenerator.

It is necessary to absorb the expansion work on the cold side. This absorbed expansion work must be removed, or transferred, out of the cold section of the device in order to produce a cooling effect. The Stirling cooler disclosed in FIG. 1 is no different than other gas cycle refrigerators in this respect. The expansion work absorbed by the cold-side element 16 must be transferred back to the hot side in order for the refrigeration cycle to work.

Figure 2:
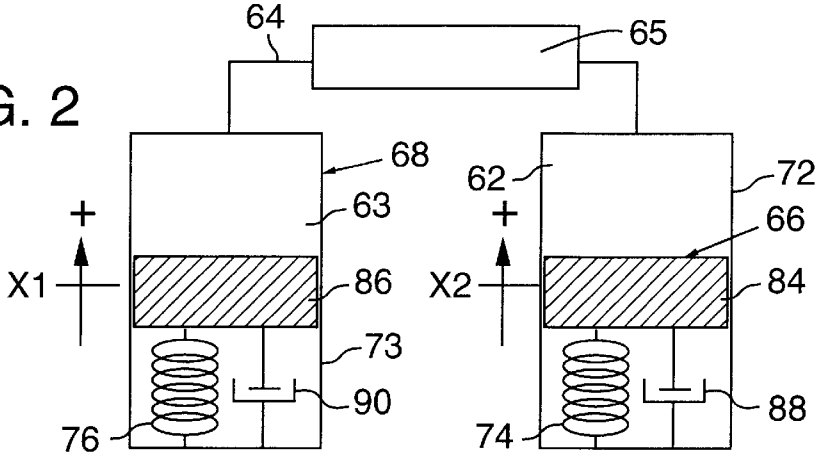
FIG. 2 is a schematic diagram of a two-piston α-Stirling device for modeling purposes.

To explain how this occurs in the resonantly coupled Stirling refrigerator, one must understand the function of each of the two oscillating elements. FIG. 2 shows a schematic of an alpha-Stirling device wherein the cold-side and hot-side movable members are pistons 84, 86 contained in cylinders 72, 73. This is an easily understood compression and expansion system for the purposes of explanation. Cold and hot variable-volume chambers 62, 63 are defined by the walls of cylinders 72, 73 and the pistons 84, 86. Springs 74, 76, which are preferably gas springs, apply a restoring force to the pistons 84, 86. Dash pots 88, 90 can be used to damp the oscillation of the pistons. A driver (not shown) is operated to cause the piston 86 to oscillate sinusoidally within its cylinder 73, which causes piston 84 to oscillate sinusoidally in sympathy within its cylinder 72. As the pistons oscillate, working fluid is alternately transferred, via a passageway 64, from one side of the device to the other.

Figure 3:
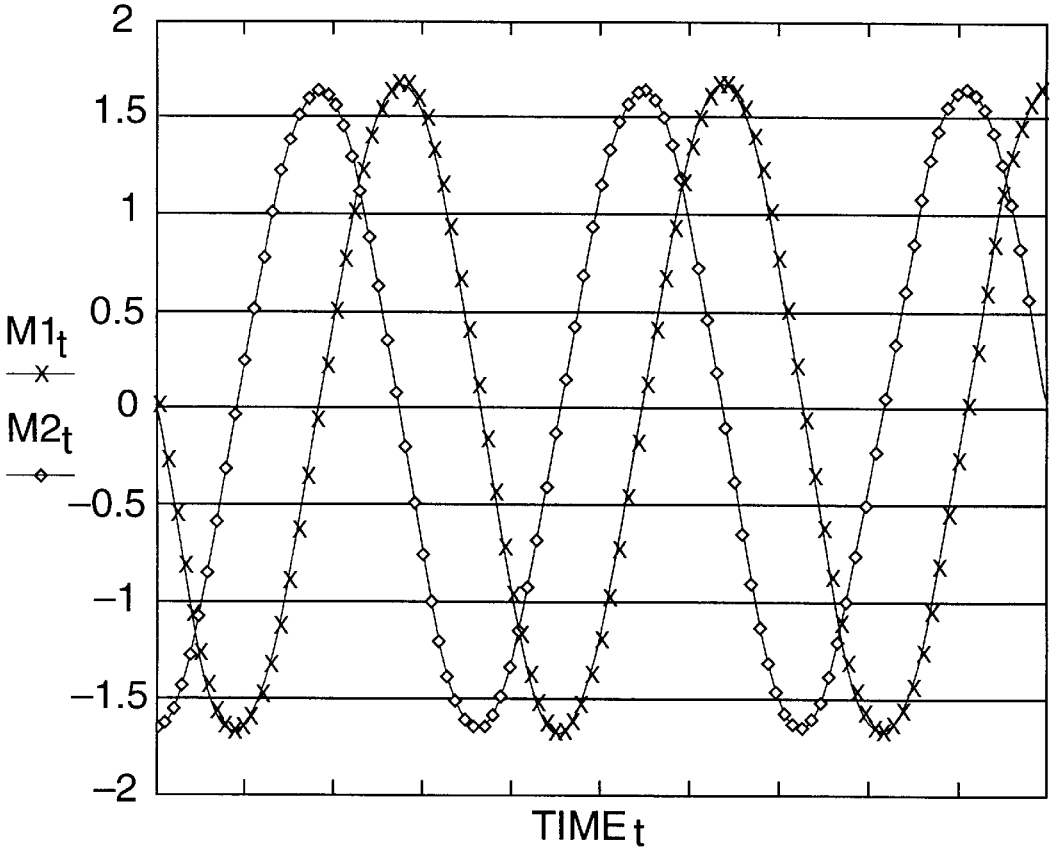
FIG. 3 is a graph displaying the displacement of each piston of the device of FIG. 2 as a function of time, demonstrating a 90° phase shift.

FIG. 3 is a graph displaying the displacement (vertical axis) of each piston 84, 86 as a function of time (horizontal axis). Displacement is measured from the positions designated X1 and X2 in FIG. 2. If the cold-side piston 84 ($M2_t$) leads the hot-side piston 86 ($M1_t$) by 90° as shown in FIG. 3, then the alternating transfer takes the form of a compress-shift-expand-shift sequence. The compression occurs in the hot variable-volume chamber 63 and the expansion occurs in the cold variable-volume chamber 62. Because of the sinusoidal nature of the piston oscillation, each process of the compress-shift-expand-shift sequence overlaps somewhat. If the phase difference between each piston is adjusted away from 90°, the overlap for some of the processes can be made more pronounced.

A key insight to recognizing how the expansion work is transferred out of the cold section is this: with sinusoidal motion of the pistons, the compression of the working fluid is not accomplished entirely by the hot-side piston 86 and the expansion of the working fluid is not accomplished entirely by the cold-side piston 84. Instead, because of resonant coupling between the two pistons, the two oscillating masses are a linked system. Furthermore, because of the 90° phase difference between the two pistons, the cold-side piston 84 partially compresses the gas during a portion of its cycle and the hot-side piston 86 partially expands the gas during a portion of its cycle. For the cold-side piston 84, this partial compression of the working fluid (the majority of which resides in the hot section) requires work. Hence expansion work absorbed during part of the cycle is used to compress the gas during another part of the cycle.

However, the entire explanation of expansion work transfer from the cold-side element 66 is more complex than this. Four mechanisms are responsible for dissipating and transferring the expansion work. The first two are dissipative and do not contribute to a cooling effect. First, if the gas spring 74 is involved with the restoring force on the cold-side element 66, then there are thermodynamic irreversibilities in the operation of the gas spring 74. This is detrimental to cooler operation since some of the expansion work would be dissipated within the cold section of the cooler by this mechanism. Second, the cold-side element 66 must expend some of its absorbed expansion work in forcing the working fluid through a regenerator 65 during one of the previously mentioned shift operations. This is again a dissipative process, but it contributes a damping effect that is conducive to stable cooler operation. One way to enhance this damping is to provide a flow restriction at the hot side end of the regenerator. This would be needed in cooler designs where the regenerator itself did not provide the degree of damping necessary for stable operation. Third, during the shift of gas back to the hot section from the cold section, the cold-side element 66 does work on the hot-side element 68 because of the coupled nature of the two-mass system. If the phase shift is 90°, then only a small portion of the shift operation accomplishes this function. However, if the phase shift is varied from its theoretical ideal, this transfer of expansion work from the cold-side element 66 to the hot-side element 68 can be enhanced. Fourth, as described in the preceding paragraph, both elements 66, 68 are responsible for both compression and expansion. A portion of the expansion work absorbed by the cold-side element 66 is used for recompressing the working fluid in the hot section. The magnitude of this latter effect can also be varied by changing the phase of operation. Hence the capability to alter phase during cooler operation provides a means of controlling the degree of expansion work transfer from the cold section. This provides a means for controlling overall cooler performance.

One other important factor in this ability to "tune" the phase difference between the flexible elements is associated with gas springs. Most embodiments of this invention use gas springs to provide at least part of the restoring force for the flexible elements. With the entire cooler sealed and pressurized, the spring constants of the gas springs will change as the device cools. By changing the drive frequency during operation, the required phase difference between the cold and hot sides of the cooler can be maintained despite changes in spring constants. These changes can be accomplished as part of a feedback system that senses a parameter of cooler operation related to cooler efficiency (e.g., temperature) and then alters drive frequency to improve efficiency (e.g., to lower temperature). In this way, thermodynamic efficiency can be optimized.

Figure 4:
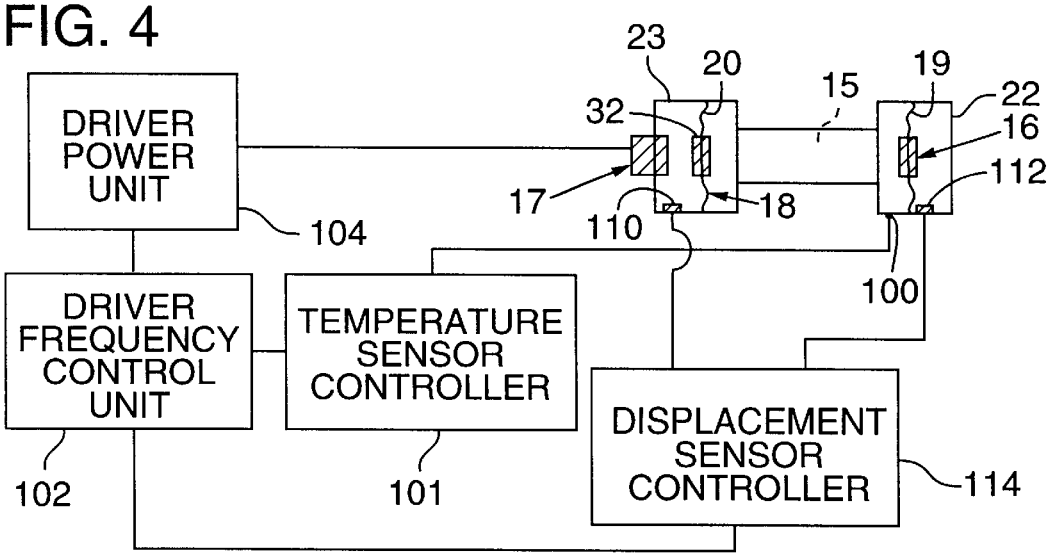
FIG. 4 is a schematic diagram of the Stirling cooler of FIG. 1 with associated control and feedback units and temperature and displacement sensors.
Figure 5:
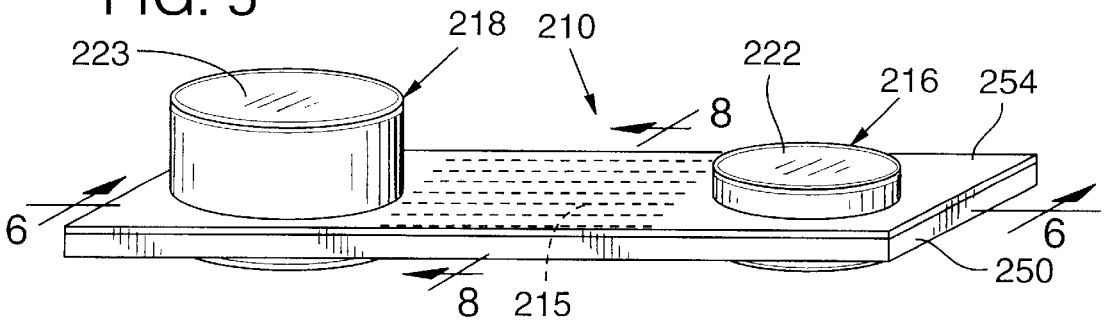
FIG. 5 is an isometric, schematic view of a miniature planer Stirling cooler with two corrugated diaphragms as the flexible volume changing elements.

The preferred embodiment of such a feedback system is shown in FIG. 4. A temperature sensor 100 such as a thermocouple, resistance temperature device (RTD), or a semiconductor sensor, is located in the cold section of the cooler and connected electrically to a temperature sensor controller 101. To start up the cooler, a frequency control unit 102 is activated to provide a signal to drive circuitry in a drive power unit 104 which serves as an adjustment system for altering the drive frequency of the driver 17. The drive power unit 104 responds to the signal from the control unit 102, sends a driver power signal to the driver 17, and thereby commences operation of the driver at the signaled frequency. Phase at start up is a preset value known to produce a cooling effect.

The temperature sensor 100 and temperature sensor controller 101 continuously monitor the drop in temperature and provide this information as signals to the control unit 102. Logic within the frequency control unit changes the phase between the oscillating hot-side element 18 and the cold-side element 16 by changing the drive frequency around the initial preset value. Phase changes affect the temperature drop in the cold section by making the cooler either more or less efficient in executing its refrigeration cycle. The frequency control unit 102 senses this efficient operation by measuring the drop in temperature. This process of changing the phase and sensing the temperature drop is continuous as the cold section of the cooler drops in temperature. This control feature seeks the optimal performance as measured by the lowest temperature achievable under a set of operating parameters such as heat load on the cold section and environmental temperature for heat rejection.

An alternate method for controlling the phase difference between the two oscillating elements is to directly sense their displacements with appropriate displacement sensors. This is depicted in FIG. 4 by sensors 110, 112 attached to the hot and cold sides of the cooler, respectively. Signals from the two sensors 110, 112 are routed to a control unit 114 which determines phase by the displacement signals. The detected phase is transmitted to the driver frequency control unit 102.

If gas springs are employed as restoring forces for the flexible elements of the cooler, the sensors 110, 112 can be pressure transducers, instead of displacement sensors, with appropriate controller features substituted in the sensor controller 114.

Devices according to the present invention are well suited to miniaturization because the use of flexible walls eliminates sliding friction and reduces sealing problems. These two effects degrade the performance of piston-based coolers as the characteristic length of the device is reduced. Moreover, in a miniature device, the working gas is closer to a solid structure thus, ideally, at the same temperature as the chamber walls at all times. This increase in the chamber area/volume ratio resulting from miniaturization will tend toward decreasing thermodynamic losses from the gas during cyclic compression and expansion of the working gas. Thus, the device shown in FIG. 1 can be reduced in size to produce a miniature refrigerator or cryocooler. Each component would be separately manufactured and then assembled into a working device. The regenerator for this configuration of a miniature cooler would dictate the size limits achievable. With a regenerator fashioned from either wire mesh, a rolled up sheet of dimpled metal, or a plurality of small tubes contained in a larger tube, a miniaturized cooler with a regenerator length scale of 1 cm and a diameter of 0.5 cm is possible.

A preferred embodiment of a miniaturized cooler based on resonant coupling is shown in FIGS. 5–8. A planer vessel 210, having a cold-side element 216 and a hot-side element 218, is shown with flexible volume-changing elements being corrugated metal diaphragms 219, 220. For the hot-side diaphragm 220, a driver 217 is provided to power the cooler. The driver 217 could be a miniaturized version of those previously mentioned, i.e. voice coil, electromagnet, or piezoelectric-based drivers could be employed. The cold-side diaphragm 219 is located on the other end of the planer vessel 210 and responds passively to the pressure variations created by the driven hot-side diaphragm 220. Device operating frequency would be much higher than the traditionally accepted operating frequencies of larger coolers; frequencies higher than 200 Hz would be employed. The diaphragms 219, 220 are constructed so that an additional mass 246, 248 can be added to each diaphragm in order to tune the elements to their proper resonant frequencies. Thus, in this embodiment, the hot-side moveable member consists of the diaphragm 220 and mass 248. The cold-side moveable member consists of the diaphragm 219 and mass 246.

Figure 8:
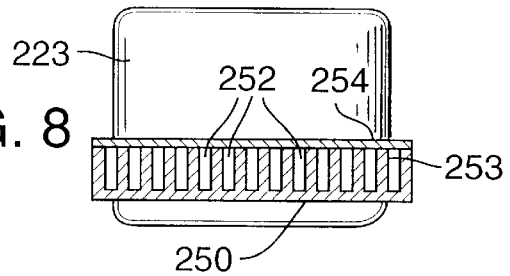
FIG. 8 is an enlarged, partial sectional view taken along line 8—8 of FIG. 5.
Figure 6:
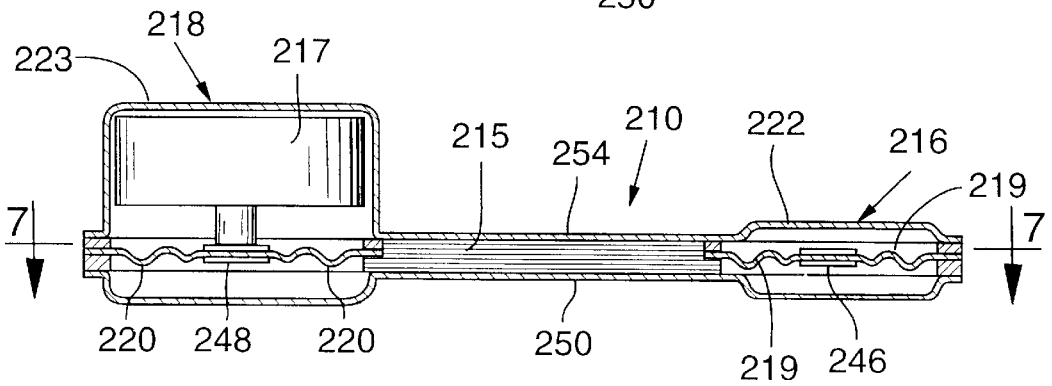
FIG. 6 is a vertical, sectional view taken along line 6—6 of FIG. 5.
Figure 7:
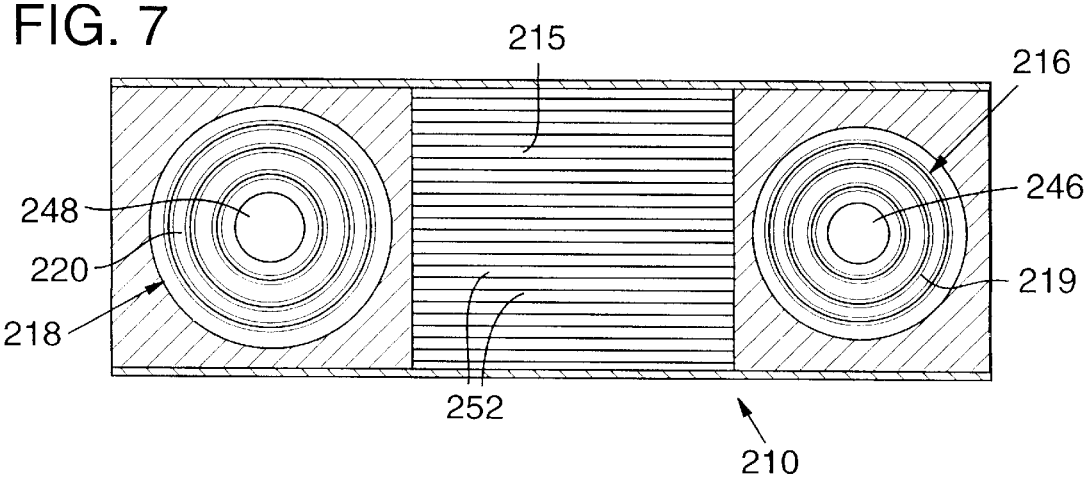
FIG. 7 is a sectional view taken along line 7—7 of FIG. 6.

A planer regenerator 215 and a cooler frame structure 250, for holding the diaphragms 219, 220 in place, would be fabricated with technology conducive to mass production. One process is etching a polymeric mold with photolithography techniques common to the microelectronics industry and then filling the mold using an electroplating process. This technique is being employed in the MEMS research community to make small-scale actuators and sensors. The regenerator 215 of a miniature cooler would be composed of a plurality of small channels 252 which may, or may not be continuous throughout the length of the regenerator. As shown in FIG. 8, a plurality of spikes, pins (either round or diamond-shaped), or fins 253 could also be employed as a miniature regenerator. In all of these cases, it is anticipated that an engineered geometry would be grown from the etched mold using electroplating techniques. Most appropriate for this process would be the plating of a low thermal conductivity alloy to make up the miniature regenerator and cooler structure.

An alternate method is to plate layers of pure metals, such as nickel and copper or nickel and chromium, into the etched polymeric mold and heat treat at a later point in the process. This creates diffusion alloys of low thermal conductivity. After the miniature regenerator and cooler frame has been formed, the upper face would be open. At this point in the process, the diaphragms 219, 220 could be inserted into the device and bonded to the frame 250. Finally, a cover plate 254 would be placed on top of the structure and also bonded to the cooler frame 250 producing a sealed structure. The illustrated plate 254 has elevated portions 222, 223 which define cavities to receive the driver 217 and diaphragm assemblies 219, 220.

In an advantageous embodiment (not shown), two of the coolers are rigidly mounted back-to-back with the drivers aligned and driven with the same frequency signal so that vibrations are damped.

Figure 9:
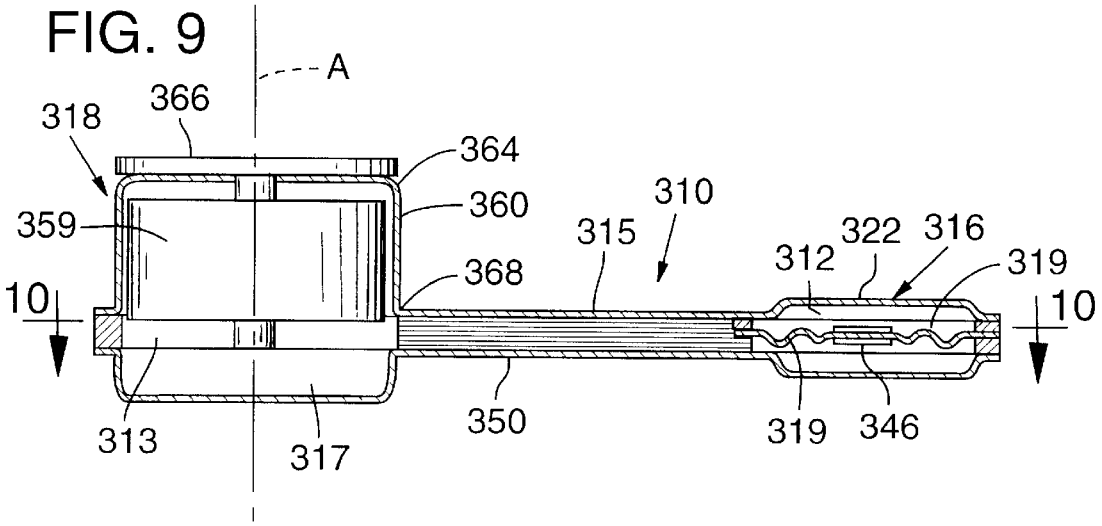
FIG. 9 is a vertical, sectional, schematic view of a miniature planer cooler with a regenerative displacer as the driver for the device.
Figure 10:
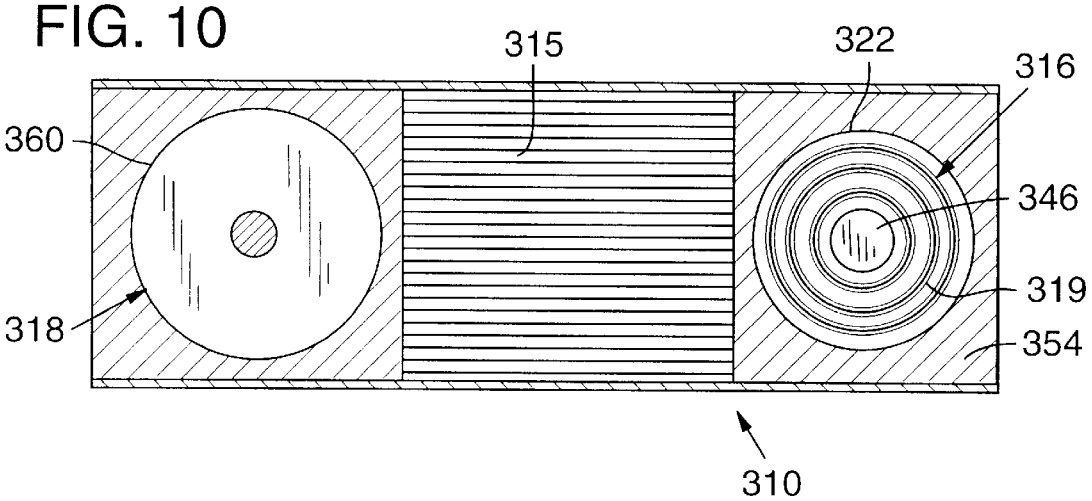
FIG. 10 is a sectional view taken along line 10—10 of FIG. 9.

FIGS. 9–10 show an alternate driving mechanism for a miniature cooler 310. Elements corresponding to those shown in FIGS. 5–8 are similarly numbered, with the numbers incremented by 100. Thermocompression is employed on the driver end of the miniature cooler to achieve alternating compression and expansion of the working gas. A thermocompressor has a driver 317 and a regenerative displacer 359 which replaces the driven diaphragm of FIGS. 6–7. The displacer is located inside a fixed volume hot chamber 313 defined by a cylinder 360. Linear flexural springs (not shown) urge the regenerative displacer 359 to a fixed radial position relative to an axis A while allowing oscillatory motion in the axial direction.

The displacer 359 is located between two regions which are at different temperatures. One region, at one end 364 of the displacer cylinder 360, resides at an elevated temperature and is supplied with heat by an external source. The preferred source for a miniature cooler is an electrical resistance heater 366 operating at above 200° C. The other region, where the opposite end 368 of the displacer cylinder 360 is sealed to a cooler frame 350 to define the displacer chamber 313, resides at a temperature characteristic of the surrounding temperature. Heat must be removed from this area of the cooler, therefore heat transfer enhancements such as external fins (not shown) could be employed in this region of the cooler. The displacer's oscillatory motion is driven in a manner not dissimilar to the way the diaphragm is driven in the device of FIGS. 5–8. However, in the case of the thermocompressor, the amount of work that must be supplied to drive the displacer 359 is less than the work required by an oscillating diaphragm. This is because the external heat source 366 supplies the majority of the energy necessary for thermocompression and the driver 317 of the displacer 359 must overcome only fluid frictional losses in shuttling gas back and forth within the displacer cylinder 360.

The thermocompression embodiment of the cooler, however, does not alter the operating principle of resonant coupling. The frequency at which the displacer 359 is driven can be selected so that the compression of the working gas in the hot-side section of the cooler is out of phase with the expansion of the gas by the resonant element in the cold section of the cooler. The displacer drive frequency can be varied independently to select the optimal phase difference between the displacer motion and the motion of the cold-side flexible element 319. This optimal phase point for cooler operation would be determined by a frequency control unit (not shown) using information from a temperature sensor in the cold section of the device in a manner as described above with reference to FIG. 4. Again, there are many similarities to the embodiments shown in FIGS. 5 and 9. In the former cases, compression in the hot-side section is provided by a strongly driven diaphragm, in the latter case compression is provided by a weakly driven displacer 359 operating between two temperatures, one an elevated temperature and the other a temperature characteristic of ambient conditions. The concept of a passively responding cold-side flexible element and the capability of phase adjustment by varying the drive frequency is common to both embodiments.

Figure 11:
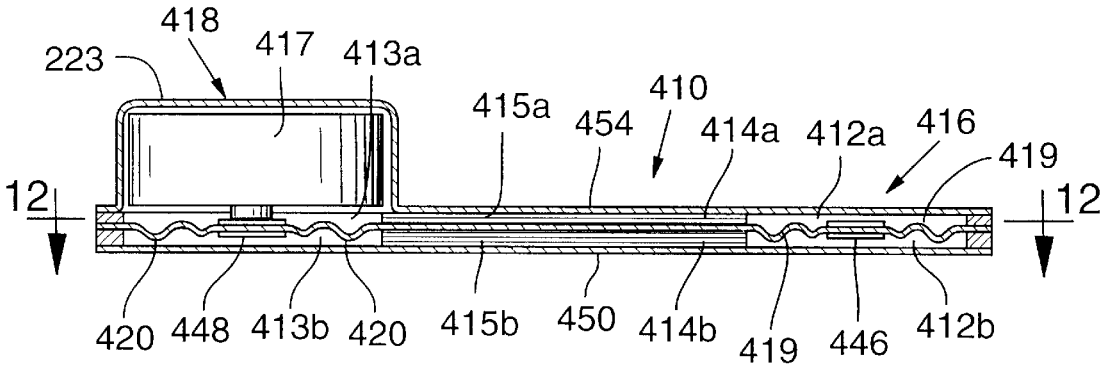
FIG. 11 is a vertical, sectional, schematic view of a double acting miniature planer cooler.
Figure 12:
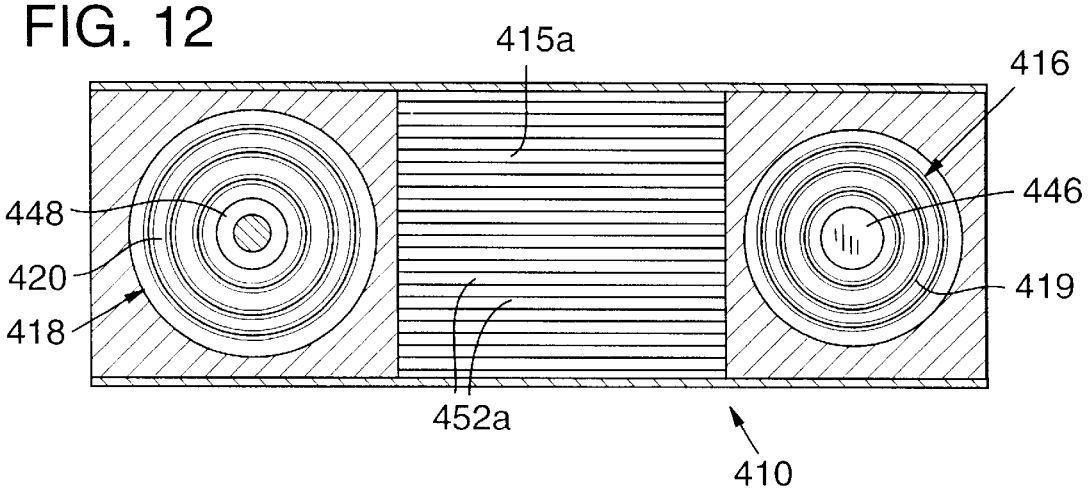
FIG. 12 is a sectional view taken along line 12—12 of FIG. 11.

FIGS. 11–12 illustrate a system for improving cooler efficiency by using both directions of a single oscillating element to form a double acting cooler. Elements corresponding to those shown in FIGS. 5–8 are similarly numbered, with the numbers incremented by 200. The double acting cooler of FIGS. 11–12 has single cold and hot corrugated diaphragms 419, 420.

A first gas-tight vessel has a wall which defines a first hot variable-volume chamber 413*a*, a first cold variable-volume chamber 412*a*, and a first passageway 414*a* which connects the first hot variable-volume chamber 413*a* with the first cold variable-volume chamber 412*a*. It should be understood that the passageway 414*a* may comprise multiple passageways extending between the chambers. The wall has a hot-side flexible portion, the diaphragm 420, which partially defines the first hot-side chamber 413*a* and a cold-side flexible portion, the diaphragm 419, which partially defines the first cold-side chamber 412*a*. A first regenerator 415*a* is located in or provided by the first passageway(s) 414*a*. A second gas-tight vessel has a wall which defines a second hot variable-volume chamber 413*b*, a second cold variable-volume chamber 412*b*, and a second passageway 414*b* which connects the second hot variable-volume chamber 413*b* with the second cold variable-volume chamber 412*a*. Again, the passageway 414*b* could comprise multiple passageways. The wall has a hot-side flexible portion, the diaphragm 420, which partially defines the second hot-side chamber 413*b* and the cold-side flexible portion, the diaphragm 419, which partially defines the second cold-side chamber 412*b*. Thus, the hot-side diaphragm 420 is suspended between and is a common wall to both the hot side variable-volume chambers 413*a*, 413*b*, and the cold-side diaphragm 419 is suspended between and is a common wall to both the cold-side variable-volume chambers 412*a*, 412*b*. A second regenerator 415*b* is located in or provided by the second passageway(s) 414*b*. Thus, the regenerators 415*a*, 415*b* are used to connect the variable-volume chamber at each side of the cold diaphragm 419 with the corresponding variable-volume chamber at each side of the hot diaphragm 420; alternatively, a single recuperative heat exchanger (not shown) could be used.

A single driver 417 is provided for oppositely varying the volume of each hot-side chamber 413*a*, 413*b* by moving the hot-side diaphragm 420, the driver providing an appropriately tuned force for maintaining reciprocating gas displacement between each set of communicating hot and cold chambers, with changes in the volume of each cold chamber responding passively through resonant coupling with the corresponding hot chamber. For example, the driver 417 varies the volume of the hot-side variable-volume chamber 413*a* by moving the hot-side diaphragm 420, with changes in the volume of the cold variable-volume chamber 412*a* responding passively. As the driver 417 moves the diaphragm 420 upwardly in FIG. 12, the volume of chamber 413*a* decreases and the volume of chamber 413*b* increases. Then, in sympathy, the volume of the chamber 412*a* increases and the volume of the chamber 412*b* decreases by passive movement of the diaphragm 419. Motion of each diaphragm results in expansion on one side of the diaphragm and compression on the other. In essence, this configuration results in two parallel Stirling machines acting 180° out of phase from each other, yielding twice the cooling capacity of the single acting machine.

Although the principles of the present invention are illustrated and described with reference to preferred embodiments, it should be apparent to those of ordinary skill in the art that the illustrated embodiments may be modified in arrangement and detail without departing from such principles. The present invention includes not only the illustrated embodiments, but all such modifications, variations, and equivalents thereof as fall within the true scope and spirit of the following claims.

I claim:

1. An a Stirling cooler comprising:

a gas-tight vessel defining hot and cold variable-volume chambers and a passageway which connects the chambers;

a regenerator located in the passageway;

a variable-frequency driver for varying the volume of one of the variable-volume chambers, the driver providing an appropriately tuned force for maintaining reciprocating gas displacement between the variable-volume chambers, with changes in the volume of the other of the variable-volume chambers responding passively through resonant coupling to changes in the volume of the one variable-volume chamber; and an adjustment system for varying the frequency of the driver and thereby altering the phase difference between the oscillations of the volumes of the variable-volume chambers.

2. An a Stirling cooler comprising:

a gas-tight vessel defining hot and cold chambers, the cold chamber being a variable-volume chamber, and a passageway which connects the chambers;

a regenerator located in the passageway; and a thermocompresssor including (a) a regenerative displacer which is movable inside the hot chamber between two positions which are at different temperatures and (b) a driver for providing an appropriately tuned force to cause the displacer to oscillate and maintain reciprocating gas displacement between the hot chamber and the cold variable-volume chamber, with changes in the volume of the cold variable-volume chamber responding passively through resonant coupling with the motion of the displacer.

3. An α-Stirling cooler comprising:

a gas-tight vessel defining hot and cold chambers, the cold chamber being a variable-volume chamber, and a passageway which connects the chambers;

a regenerator located in the passageway; and a thermocompressor including (a) a regenerative displacer which is movable inside the hot chamber between two positions which are at different temperatures and (b) a driver for providing an appropriately tuned force to cause the displacer to oscillate and maintain reciprocating gas displacement between the hot chamber and the cold variable-volume chamber, with changes in the volume of the cold variable-volume chamber responding passively through resonant coupling with the motion of the displacer, the driver being a variable-frequency driver which can be adjusted in frequency of operation to alter the phase difference between the oscillations of the cold variable-volume chamber and the displacer.

4. The cooler of claim 2 further comprising a heater positioned such that the displacer is located between the heater and the hot chamber.

5. An a Stirling cooler comprising:

a gas-tight vessel defining hot and cold variable-volume chambers and a passageway which connects the chambers;

a regenerator located in the passageway;

a driver for varying the volume of one of the hot and cold variable-volume chambers, the driver providing an appropriately tuned force for maintaining reciprocating gas displacement between the variable-volume chambers;

a sensor for sensing a parameter of cooler operation related to cooler efficiency; and a feedback system which responds to the sensed parameter by altering the drive frequency such that cooler efficiency is increased.

6. The cooler of claim 5 wherein the sensor is a temperature sensor.

7. The cooler of claim 5 wherein the sensor is a displacement sensor.

8. The cooler of claim 5 wherein the sensor is a pressure transducer.

9. An a Stirling cooler comprising:

a gas-tight vessel defining hot and cold variable-volume chambers and a passageway which connects the variable-volume chambers, each chamber being defined by a wall which includes a flexible portion which is capable of repetitive deflection;

a regenerator located in the passageway; and a driver for varying the volume of the hot variable-volume chamber by causing the flexible portion of the wall of the hot variable-volume chamber to move, the driver providing an appropriately tuned force for maintaining reciprocating gas displacement between the variable-volume chambers, with changes in the volume of the cold variable-volume chamber responding passively through resonant coupling with the hot variable-volume chamber;

an adjustment system for varying the frequency of the driver;

a sensor for sensing a parameter of cooler operation related to cooler efficiency; and a feedback system which responds to the sensed parameter by signaling the adjustment system to alter the drive frequency of the driver such that the phase difference between the oscillations of the volumes of the variable-volume chambers is altered in a manner which increases cooler efficiency.

10. A method for operating an α-Stirling cooler having (a) a gas-tight vessel which defines hot and cold variable-volume chambers and a passageway which connects the variable-volume chambers, (b) a regenerator located in the passageway, and (c) a variable-frequency driver which continuously varies the volume of one of the variable-volume chambers and thereby maintains reciprocating gas displacement between the variable-volume chambers, the method comprising:

periodically sensing a parameter related to cooler efficiency; and in response to the value of the parameter sensed, adjusting the drive frequency of the driver to alter the phase difference between the oscillations of the volumes of the variable-volume chambers and thereby increase cooler efficiency.

11. A method for operating an α-Stirling cooler comprising:

providing a Stirling cooler having (a) a gas-tight vessel which defines hot and cold variable-volume chambers and a passageway which connects the variable-volume chambers, (b) a hot-side movable member and a cold-side movable member which, when moved, vary the volume of the hot and cold variable volume chambers respectively, (c) a regenerator located in the passageway, and (d) a variable-frequency driver suitable to vary the position of the hot-side movable member; and operating the driver to continuously vary the position of the hot-side moveable member at the resonant frequency of the cold-side movable member to maintain reciprocating gas displacement between the variable-volume chambers.

* * * * *

UNITED STATES PATENT AND TRADEMARK OFFICE

CERTIFICATE OF CORRECTION

PATENT NO. : 5,813,235
DATED : September 29, 1998
INVENTOR(S) : Richard B. Peterson It is certified that error appears in the above-identified patent and that said Letters Patent is hereby corrected as shown below:

Column 3,
Line 58, reads "Prandt1", should read -- Prandtl --

Column 11,
Line 63, reads "An a Stirling", should read -- An ∝ Stirling --

Column 12,
Line 13, reads "An a Stirling", should read -- An ∝ Stirling --
Line 51, reads "An a Stirling", should read -- An ∝ Stirling --

Column 13,
Line 5, reads "An a Stirling", should read -- An ∝ Stirling --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*